United States Patent [19]

Itoh

[11] Patent Number: 5,057,875

[45] Date of Patent: Oct. 15, 1991

[54] IMAGE FORMING APPARATUS PROVIDED WITH AN IMAGE BEARING FILM AND A MOVABLE TRANSFIXING STATION

[75] Inventor: Shinichi Itoh, Tokyo, Japan

[73] Assignee: Oki Electric Industry Co., Ltd., Tokyo, Japan

[21] Appl. No.: 470,169

[22] Filed: Jan. 25, 1990

[30] Foreign Application Priority Data

| | | | |
|---|---|---|---|
| Jan. 27, 1989 | [JP] | Japan | 1-16309 |
| Jan. 27, 1989 | [JP] | Japan | 1-16310 |
| Jan. 27, 1989 | [JP] | Japan | 1-16311 |
| Jan. 27, 1989 | [JP] | Japan | 1-16312 |

[51] Int. Cl.[5] ..... G03G 15/01; G03G 15/14; G03G 15/20

[52] U.S. Cl. ..... 355/326; 355/277; 355/279; 355/290

[58] Field of Search ..... 355/326, 327, 212, 271, 355/277, 279, 282, 290

[56] References Cited

U.S. PATENT DOCUMENTS

| | | | |
|---|---|---|---|
| 2,357,809 | 9/1944 | Carlson | 355/210 |
| 3,591,276 | 7/1971 | Byrne | 355/290 |
| 3,893,761 | 7/1975 | Buchan et al. | 355/279 X |
| 3,904,875 | 9/1975 | Rees et al. | 355/271 X |
| 3,924,945 | 12/1975 | Weigl | 355/271 X |
| 3,927,934 | 12/1975 | Cook | 355/271 |
| 3,937,572 | 2/1976 | Gaynor et al. | 355/212 X |
| 4,542,978 | 9/1985 | Tarumi et al. | 355/279 |
| 4,578,331 | 3/1986 | Ikeda et al. | 355/327 X |
| 4,682,880 | 7/1987 | Fujii et al. | 355/327 |
| 4,843,427 | 6/1989 | Ibuchi | 355/218 |
| 4,912,514 | 3/1990 | Mizutani | 355/282 X |
| 4,933,727 | 6/1990 | Mizuma et al. | 355/327 |

FOREIGN PATENT DOCUMENTS

| | | | |
|---|---|---|---|
| 3403303 | 8/1984 | Fed. Rep. of Germany | 355/326 |
| 41679 | 12/1971 | Japan . | |
| 0125766 | 7/1984 | Japan | 355/326 |
| 0226766 | 10/1986 | Japan . | |

OTHER PUBLICATIONS

Nakao, et al. Color laser-printer using roller-transfer, SPIE vol. 1079, Hard Copy Output (1989), pp. 76-79.

*Primary Examiner*—A. T. Grimley
*Assistant Examiner*—Nestor R. Ramirez
*Attorney, Agent, or Firm*—Spencer & Frank

[57] ABSTRACT

In a color image forming method and apparatus utilizing electrophotography, a toner image bearing film is passed around a photosensitive member and moved past a transfer device, the photosensitive member is uniformly charged, and is then exposed to light images corresponding to different color components of the image. Developing devices are provided facing the toner image bearing film passing around the photosensitive member, and toners of different colors are then made to adhere to the toner image bearing film because of the latent image on the photosensitive member. Thus, the images of color toners are formed on the toner image bearing film, and then transferred to a recording paper. The images of color toners may be transferred one by one, or simultaneously. In the latter case, images of the colors, except or including the last-developed one, are temporarily fixed on the toner image bearing film, by application of heat, and then transferred to the recording paper. Transferring is facilitated by two rollers, one of which moves toward and away from the other roller.

22 Claims, 21 Drawing Sheets

IMAGE FORMING APPARATUS PROVIDED WITH AN IMAGE BEARING FILM AND A MOVABLE TRANSFIXING STATION

BACKGROUND OF THE INVENTION

1. Field of the Invention

This invention concerns a method and apparatus for forming color images by means of electrophotography.

2. Discussion of the Background

Conventionally, when forming color images by means of electrophotography, a photosensitive drum and a transfer drum carrying recording paper are made to rotate together a plurality of times, and images on the photosensitive drum are transferred the same number of times onto the recording paper on the outer surface of the transfer drum so as to overlay each other.

FIG. 1 is a simplified drawing of a color electrophotographic copier employing the conventional color image-forming method (as shown for example in Japanese Patent Application Publication No. 34467/1988; and Proceedings of the Inst. of Electrostatics Japan, Vol. 9, No. 4. pp. 253–261, 1985).

In the figure, the surface of a photosensitive drum 1 which rotates at a fixed speed in the counterclockwise direction, is electrostatically charged with a specified polarity by a corona discharge device 2.

When an image of the original is formed by the exposure system 3 on the electrified surface of the photosensitive body, the charge on the photosensitive body is lost according to the density of the respective parts of the image of the original, and electrostatic latent images are thereby formed. These latent images are then rendered visible by a developing device 4. In the case of a color copier, this developing device 4 comprises at least three devices, namely a device for developing yellow images 5, a device for developing magenta images 6, and a device for developing cyan images 7.

The exposure device 3 is therefore provided with blue, green and red color separation filters. The developing device 4 may also be provided with a device for black development in order to adjust the color tone if necessary.

Developing is performed for each color separately. First, when a color image of the original is projected on the photosensitive body using the blue filter, an electrostatic latent image consisting of a yellow element which is the complementary color to blue is formed thereon. This is then rendered visible by the yellow developing device 5. The yellow developing device 5 contains a developing agent of a yellow toner and an iron powder carrier. These two components are mixed together with stirring, and the toner is triboelectrified with a polarity opposite to that of the charge on the electrostatic latent image. Both the toner and carrier are attached onto the developing roller 5*a*, and are transported to the developing area which is near the photosensitive drum 1.

Next, the green and red color separation filters are selected, the magenta and cyan toners are developed, and the toner images are copied onto a recording paper 9 via a transfer drum 8 to form color images on the paper.

However, in the conventional color image-forming method, the outer circumference of the transfer drum 8 must be arranged to be longer than the length of the recording paper 9.

If for example the largest size of the recording paper 9 which can be recorded is B4 (JIS Standard), its dimension in the longer direction is 364 mm. In order that the recording paper of this B4 size can be wound onto the transfer drum 8 without superposing, the outer diameter of the transfer drum 8 must be not less than 116 mm.

Because a mechanism required to hold the recording paper 9 at a fixed point must also be provided on the circumference thereof, the transfer drum 8 must have larger dimensions than the above, and the color copier becomes bulky.

Further, the mechanism required to load the recording paper 9 on the transfer drum 8, form a recorded image on the paper 9, and release the paper 9, is complex. The cost of the copier therefore increases, and the paper frequently jams.

Moreover, in the above conventional method of forming color images, costly and bulky color separation filters are required, and a means of selecting them must also be provided.

SUMMARY OF THE INVENTION

This invention aims to eliminate need for the transfer drum and the mechanism to load the recording paper on the photosensitive member, form a recorded image on the paper and release the paper, as well as to reduce the frequency of paper jamming.

This invention also aims to facilitate the back and forth transport of the recording paper after transfer and fixing, by having toner images transferred to and fixed on the recording paper by means of thermal energy, thereby enabling a roller to be pressed against the recording paper to which the toner images have been transferred.

This invention also aims to eliminate need for separate filters and means for selectively using them, through the use of a toner image bearing film having the functions of the color filters, so that the cost of the color image forming apparatus and the area which it occupies can be reduced.

According to the invention, a toner image bearing film is passed around a photosensitive member, which is uniformly charged, and exposed successively to a light image corresponding to a first color thereby forming an electrostatic latent image of said first color, to a light image corresponding to a second color thereby forming an electrostatic latent image of said second color, and to a light image corresponding to a third color thereby forming an electrostatic latent image of said third color. Developing devices for said first, second and third colors, face the photosensitive member through the toner image bearing film, so that the toner images of said first, second and third colors are developed on the toner image bearing film when it passes around said photosensitive member. The toner image bearing film is moved past a transfer section, where the toner images are transferred to a recording paper, which is moved in time with the toner image bearing film.

The transfer device may comprise a first roller and a second roller juxtaposed with each other. Preferably, one of the first and second rollers is a heating roller and the other is a pressure roller, so that they also serve as a fixing means.

In one embodiment of the invention, the pressure roller is pressed against the heating roller when the toner image bearing film bearing the toner image of each color passes between the heating roller and the pressure roller, the feeding means moves the recording paper backward after the transfer of the toner image of each color, and the pressure roller is separated from the heating roller when the recording paper is moved backward. In this way, the toner images of the respective colors are successively transferred to and fixed on the recording paper.

In another embodiment, the pressure roller is separated from the heating roller when the toner image bearing film bearing the toner images of the respective color passes between the heating roller and the pressure roller until the toner images of all the colors have been formed, toner images of a plurality of colors are successively formed, being superimposed with each other, and temporarily fixed on the toner image bearing film by heat from the heating roller, and the feeding means feeds the recording paper when the toner images of all the colors have been formed on the toner image bearing film. In this way, the toner images of all the colors are simultaneously transferred to and fixed on the recording paper.

In a further embodiment, the first roller is a pressure roller and the second roller is a heating roller, the heating roller is kept pressed against the pressure roller when the toner image bearing film bearing the toner image of each color passes between the heating roller and the pressure roller, toner images of a plurality of colors are successively formed, being superimposed with each other, and temporarily fixed on the toner image bearing film, and the feeding means feeds the recording paper when the toner images of all the colors have been formed on the toner image bearing film. In this way, the toner images of a plurality of colors constituting the color image are simultaneously transferred to and fixed on the recording paper.

In a yet further embodiment, the toner image bearing film has a first filter part, a second filter part, and a third filter part which are successively formed along the length of said toner image bearing film, the exposure device is provided facing the photosensitive member through the toner image bearing film, for successively exposing the photosensitive member through the first filter to form a latent image of a first color, through the second filter part thereby to form a latent image of a second color, and through the third filter part thereby to form a latent image of the third color, with the first, second and third filters being filters of colors complementary to the first, second and third colors, respectively, the developing devices successively develop toner images of the first, second and third colors onto the first filter part, onto the second filter part, and onto the third filter part, and the feeding means feeds the recording paper past the transfer device in time with the passage of the first, second, and third filter parts past the transfer device, and moves the recording paper backward after the transfer of the toner image from the first and second filter parts, and the toner images of the first, second and third colors are successively transferred to the recording paper.

This invention thus offers the following advantages:

(1) As the transfer step and fixing step may be combined, there is no need for a transfer drum, nor any need for a mechanism to load the photosensitive member with the recording paper, form a recorded image and release the paper. The apparatus can thus be more compact, its cost can be reduced, and as its construction permits easy paper feeding, the frequency of paper jamming can be reduced.

(2) As the photosensitive member is not subject to contact friction as it was in the conventional developing step or cleaning step, the lifetime of the photosensitive member is extended.

(3) The perturbation of the image, which occurs in the conventional electrostatic transfer process, can be avoided.

(4) When transfer and fixing are carried out simultaneously, a roller can be brought into pressure-contact with the surface of the recording paper to which the toner images have been transferred, and the back and forth transport of the recording paper after transfer and fixing can thus be implemented by a simple mechanism.

(5) Images can also be formed on rough paper such as bond paper, which was regarded as difficult in the conventional electrostatic transfer process.

(6) Because color separation filters to irradiate the photosensitive member with blue, green and red light can be eliminated, means for selecting filters and means for controlling such a device can therefore be eliminated. The cost of manufacturing the image forming apparatus, and the space it occupies, can therefore be reduced.

(7) As there is no need to apply pressure when the toner images developed on the toner image bearing film are melted, there is no offset onto pressure members such as the pressure roller. There is thus no need to clean away toner, maintenance of pressure members is therefore facilitated, and costs can be reduced.

(8) As a cleaning step for removing residual toner powder from the photosensitive member can be omitted, the apparatus can be made even more compact, and its cost can be reduced.

(9) As the cleaning step can be eliminated, scattering of toner inside and outside the apparatus can be reduced.

(10) As there is no need to dispose of toner after cleaning, soil of the operator or his clothing with toner can be avoided, and maintenance work can be reduced.

DETAILED DESCRIPTION OF THE EMBODIMENTS

Embodiment 1

An embodiment of this invention will now be described with reference to FIGS. 2 to 7D.

Figure 1:
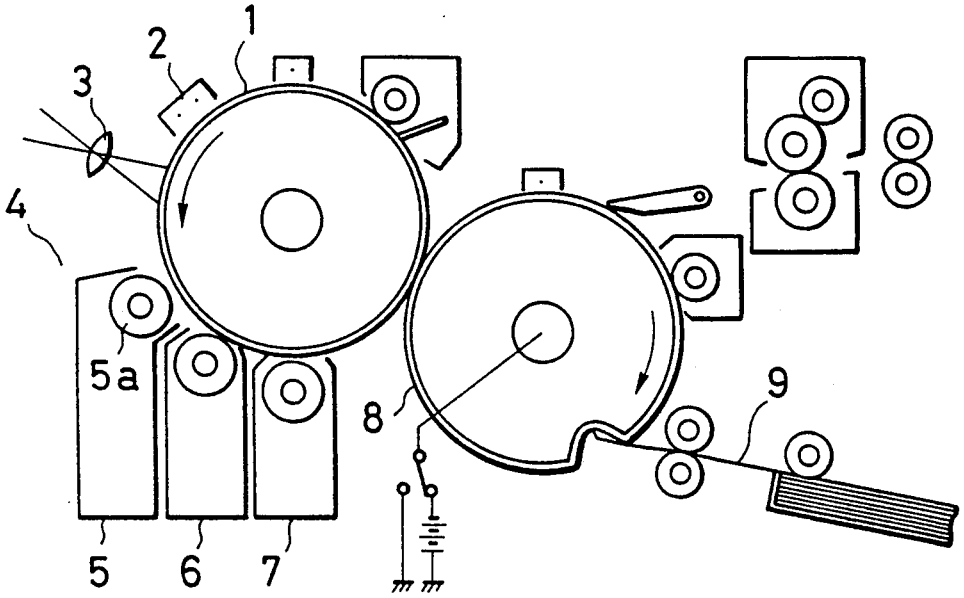
FIG. 1 PRIOR ART
FIG. 1 is a schematic drawing of a prior art color electrophotographic copier employing the conventional color image-forming method.
Figure 2:
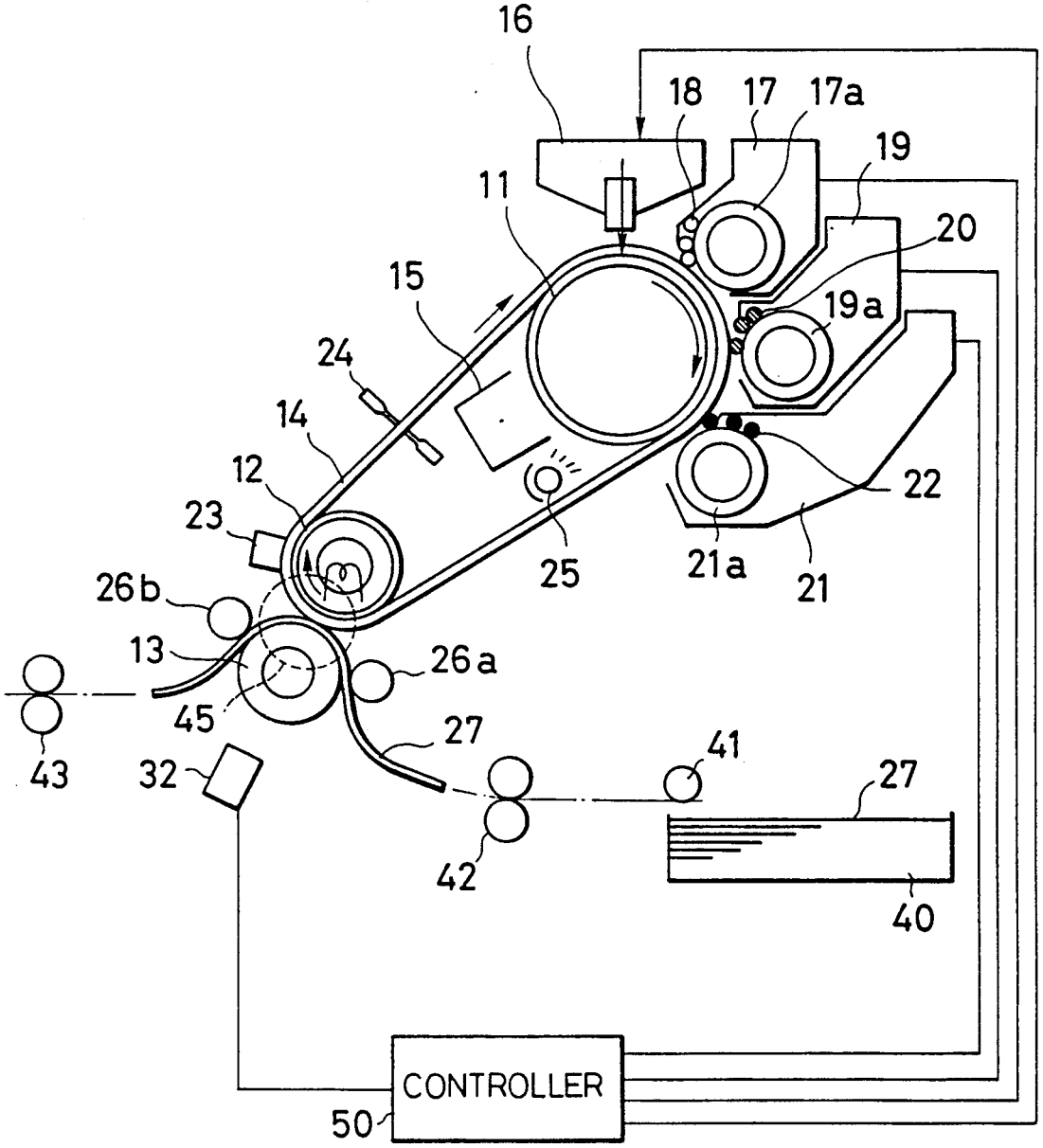
FIG. 2 is a schematic drawing of the color image-forming apparatus of Embodiment 1 according to the present invention.

FIG. 2 is a schematic drawing of the color image-forming apparatus according to the invention.

The illustrated color image forming apparatus comprises a photosensitive drum 11 rotatably mounted on a frame, not shown. The photosensitive drum 11 may be one having a selenium photosensitive body comprising a photosensitive layer on an electrically conducting support, a negatively charged organic photosensitive body, or a positively charged organic photosensitive body.

The color image forming apparatus also comprises a transfer and fixing section 45 formed of a heating roller 12 and a pressure roller 13 which are juxtaposed with each other. The heating roller 12 may be of a hollow metal member enclosing a halogen lamp, or one having a heat-emitting body on a metal surface. The surface of the pressure roller 13 is covered with silicone rubber in order to provide heat stability.

An endless toner image bearing belt or film 14 is passed around the photosensitive drum 11 and moves past the transfer and fixing section 45. More particularly, the toner image bearing film 14 is in contact, on a first or inner surface thereof, with the peripheral surface of the photosensitive drum 11 over a portion of the photosensitive drum arc, and as the photosensitive drum 11 rotates, the toner image bearing film 14 moves together with the photosensitive drum 11. Where the toner image bearing film 14 moves past the transfer and fixing section 45 it passes around the heating roller 12 and between the heating roller 12 and the pressure roller 13.

The pressure roller 13 can selectively assume one of two positions: a contact position in which it is pressed against the heating roller 12 clamping the toner image, bearing film 14, and a release position in which it is separated from the heating roller 12. The pressure roller 13 is moved between the two positions by a means to be described later with reference to FIG. 3 and FIG. 4.

The elasticity of the silicone rubber layer of the pressure roller 13, the diameter of the pressure roller 13, and the pressing force applied between the pressure roller 13 and the heating roller 12 are so designed as to provide a just enough nip width.

As the photosensitive drum 11 rotatoes its surface sequentially passes various processing sections or devices, namely, a charging or electrifying device 15, an exposure device 16, developing devices 17, 19 and 21, and a discharge lamp 25. It should be noted that some of the processing devices, i.e., the exposure device 16, and the developing devices 17, 19 and 21, are provided to face the photosensitive drum, not directly, but through the toner image bearing film 14. Between the location where the electrifying device 15 confronts the photosensitive drum 11 and the location where the exposing device confronts the photosensitive drum 11, the toner image bearing film 14 is brought into contact with the photosensitive drum 11. Between the location where the developing devices 17, 19 and 21 confront the photosensitive drum 11 and the location where the discharging lamp 25 confronts the photosensitive drum 11, the toner image bearing film 14 is separated from the photosensitive drum 11.

The electrifying device 15 is a corona discharge device for providing an electrostatic charge uniformly over the photosensitive surface of the photosensitive drum 11. The electrifying device 15 may alternatively be formed of a brush discharge device.

The exposure device 16 exposes the photosensitive drum 11 through the toner image bearing film 14 to a light image or radiation pattern to form an electrostatic latent image on the photosensitive surface of the photosensitive drum 11. The areas which have been irradiated by light are discharged, while the areas or dots of the photosensitive drum which have not been irradiated are kept charged, so the latent image consists of charged areas and discharged areas. This does not mean that each area assumes either of the two distinct state, the charged and the discharged: there can be intermediate state and the degree to which each area is discharged depends on the density of the respective areas of the image. However, in the following description, it is assumed that the image consists of charged areas and discharged areas for the sake of simplicity of illustration.

The exposure is repeated the same number of times as the number of the colors of the toners with which the color image is formed. In the embodiment illustrated, toners of the three primary colors, yellow, magenta and cyan are used, so the exposure is repeated three times, and the light pattern at each exposure is for the image of each color component. The toner image bearing film 14 must therefore be transparent to the wavelengths of the light used for the exposure.

The exposure device 16 may be a combination of a light source such as a laser or an LED array and an optical imaging system, and in this case, the light pattern for each color is produced by electrical signals representing the image of each color. Such electrical signals are supplied from a controller 50 which performs the overall control of the apparatus. The exposure device 16 may alternatively be a combination of an illuminating device illuminating an original document and an optical system for directing the light reflected at the surface of the original to the photosensitive surface of the drum 11 through filters of colors complementary to the colors of the toners. In such a case, the selective placement or insertion of the filters are made by means, not shown, under control of the controller 50.

The developing devices 17, 19 and 21 are the ones for applying toners of yellow (Y), magenta (M) and cyan (C). These developing devices 17, 19 and 21 are installed facing the outer surface of the toner image bearing film 14 which moves in close contact with the photosensitive drum 11, as described above. They are respectively provided with developing agent supports 17*a*, 19*a* and 21*a* for yellow (Y), magenta (M) and cyan (C) toners 18, 20 and 22. The toners are attached to the supports and transported so as to develop the toner images on the outer surface of the toner image bearing film 14. The developing devices may be a binary (two-component) magnetic brush developer, a unitary (one-component) magnetic brush developer, or a unitary non-magnetic brush developer. The developing devices 17, 19 and 21 are successively activated by the controller 50 in accordance with the color of the latent image which has just been formed by the exposure device 16.

The discharge lamp 25 is provided so as to face the part of the photosensitive drum 11 which has just separated from the toner image bearing film 14 after developing. The function of the discharge lamp 25 is to irradiate the entire photosensitive drum to dissipate all of the charge on it, thereby making it ready for the next operation.

As described earlier, the toner image bearing film 14 passes around the photosensitive drum 11, and the transfer and fixing section 45. The toner image bearing film 14 also passes a fixing cleaner 23 and then a discharge brush 24.

The cleaner 23 is disposed on the opposite side of toner image bearing film 14 from the heating roller 12, but after the transfer and fixing section 45. The function of the cleaner 23 is to remove any residual toner from the toner image bearing film 14 after transfer of the toner image to a recording paper 27 to be described later.

The discharge brush 24 is provided in contact with the toner image bearing film 14. The function of the discharge brush 24 is to remove any residual electrostatic charge from the toner image bearing film 14.

Pinch rollers 26*a* and 26*b* are pressed against the pressure roller 13, on both sides of transfer and fixing section 45, such that the recording paper 27 is wound on the pressure roller 13 over a sufficient portion of the pressure roller arc.

The paper feed system for the recording paper 27 is comprised of a paper feed cassette 40, a paper pick-up roller 41, paper advance rollers 42 and paper eject roller 43. Their operation, i.e., forward and backward rotation, are controlled by the controller 50.

Now the mechanism for moving the pressure roller 13 between the two positions is described with reference to FIG. 3 and FIG. 4.

As illustrated, a frame 28 supporting the heating roller 12 and a frame 29 supporting the pressure roller 13 are supported such that they can rotate freely on a pivot 30. The pressure roller 13 is pressed against the heating roller 12 by the tensile force of a spring 31 attached to the frames 28 and 29.

A solenoid 32 serves to apply a back-and-forth motion to a shaft 33, and causes the frame 29 to move about pivot 30, such that the pressure roller 13 is pressed against or separated from the heating roller 12. When the pressure roller 13 is in the contact position, the transfer and fixing process is carried out with a recording paper 27 being passed between the pressure roller 13 and the toner image bearing film 14 on the heating roller 12. When the pressure roller 13 is in the release position, the recording paper 27 may be moved backward, e.g., after transfer of a toner image of one color and to be ready for transfer of toner image of another color.

The excitation and de-excitation of the solenoid 32 is controlled by the controller 50. In place of the solenoid 32, any other actuator may be used to selectively move the pressure roller 13 between the two positions.

The way in which a color image is formed by the above apparatus will now be described.

The photosenstive drum 11 and the heating roller 12 are rotated at a constant peripheral speed in the directions shown by the arrow in the figure by a drive mechanism not shown. As a result, due to the friction with the photosensitive drum 11 and the heating roller 12, the toner image bearing film 14 is moved in the direction shown by the arrow.

The image-forming processes will be described with reference to FIG. 5A to FIG. 7D.

Figure 5A:
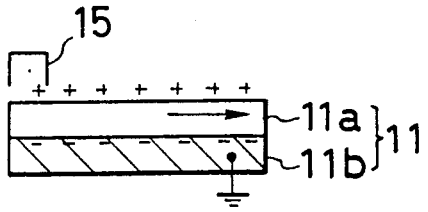
FIGS. 5A to 5D show the electrifying step, the exposure step, the developing step, and the transfer and fixing step that occur in the case of yellow toner.

In the electrifying step shown in FIG. 5A, the surface of the photosensitive drum 11 is directly charged uniformly by the corona discharge device 15. The figure shows the case where a selenium photosensitive body is used. In this case, when a high voltage is applied to the corona discharge device 15, the surface is charged positively.

Figure 5B:
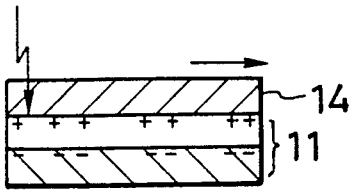

In the subsequent exposure shown in FIG. 5B, a light image corresponding to the yellow image signal produced by the exposure device 16 irradiates the photosensitive layer 11*a* of the photosensitive drum 11 to form an electrostatic latent image for the yellow component of the color image.

Figure 5C:
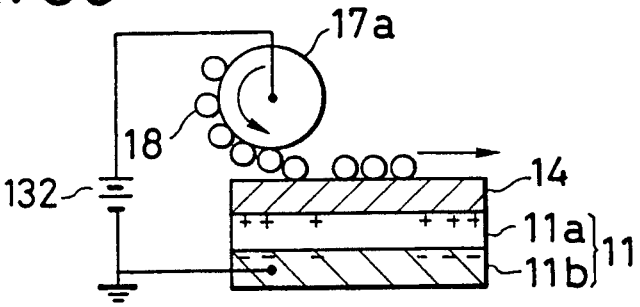

Next, in the developing step shown in FIG. 5C, reversal development is used, and a means 132 of applying a bias potential is connected across the electrically conducting support 11*b* of photosensitive drum 11 and the toner support 17*a*, to apply a bias potential. The discharged areas of the latent image on the photosensitive drum 11 attract the positively charged yellow toner 18, and the attracted yellow toner 18 is attached to the outer surface of the toner image bearing film 14 directly over the discharged areas. More specifically, electric lines of force are generated between the developer support 17*a* and the discharged areas of the latent image on the photosensitive drum 11. The electric lines of force pass through the toner image bearing film 14. The particles of the yellow toner 18 travel along these electric lines of force and adhere to the outer surface of the toner image bearing film 14, and are held there by a relatively weak electrostatic force.

Figure 5D:
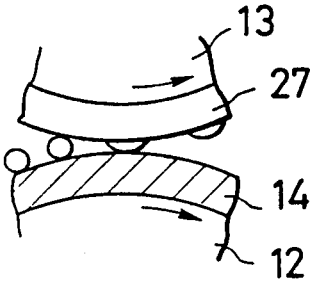

Finally, the toner image on the toner image bearing film 14 is moved past the transfer and fixing section 45 where the transfer and fixing step shown in FIG. 5D takes place. In synchronism with the toner image on the toner image bearing film 14, the recording paper 27 is fed to the transfer and fixing section 45. More specifically, the recording paper is supplied from a paper supply cassette 40, being picked up by a pick-up roller 41, and is advanced by the paper advance rollers 42, in synchronization with the toner images on the toner image bearing film 14, such that the leading edge of the recording paper (to be precise, the leading edge of the area in which the color image is to be reproduced) comes into contact with the leading edge of the area of the toner image bearing film 14 in which the toner image is formed. The toner image bearing film 14 and the recording paper 27 are moved at the same speed. The recording paper 27 and the toner image bearing film 14 are held between the pressure roller 13 and the heating roller 12. The yellow toner image on the toner image bearing film 14 is therefore melted by the heat of the heating roller 13, in this embodiment whereupon the pressure causes melted toner 18 to permeate the fibers of the recording paper 27. This transfers and fixes the toner images so as to form a yellow image on the recording paper 27.

Figure 3:
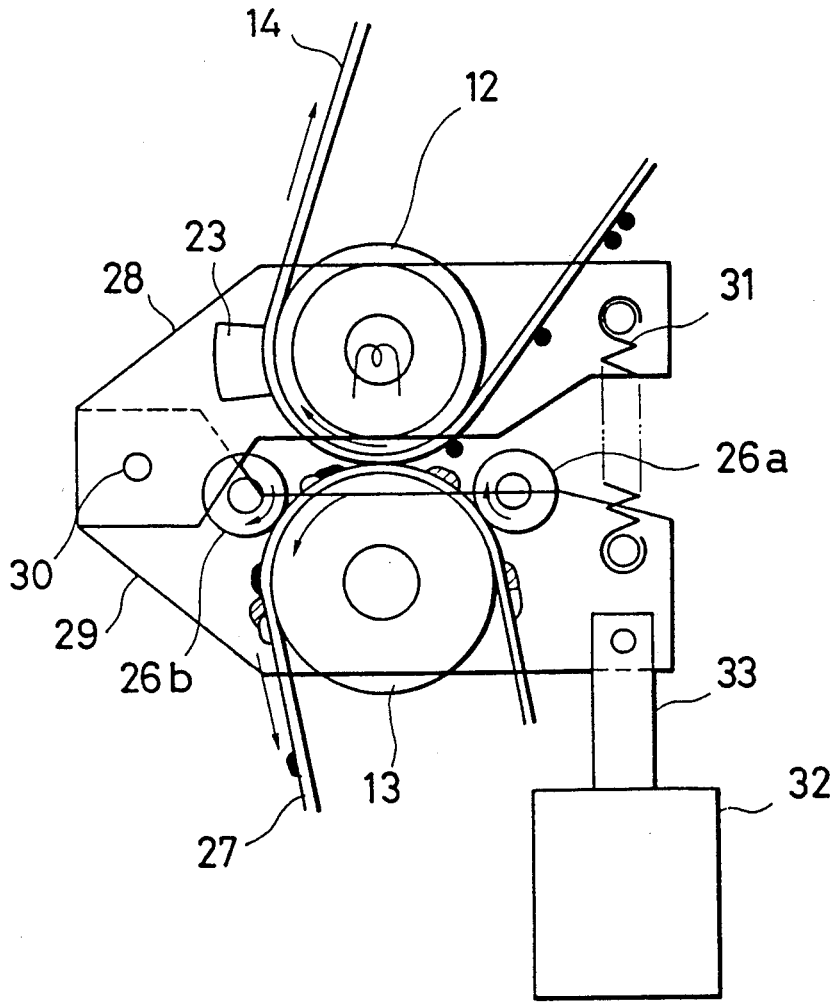
FIG. 3 shows the state of the apparatus during the transfer and fixing step according to Embodiments 1 and 2 of the present invention.

When the transfer and fixing process occurs, the magnetization of the solenoid 32 is interrupted, and the pressure roller 13 is pressed against the heating roller 12 by the tensile force of the spring 31 so as to hold the toner image bearing film 14 and the recording paper 27 between it and the heating roller 12, as shown in FIG. 3.

Figure 4:
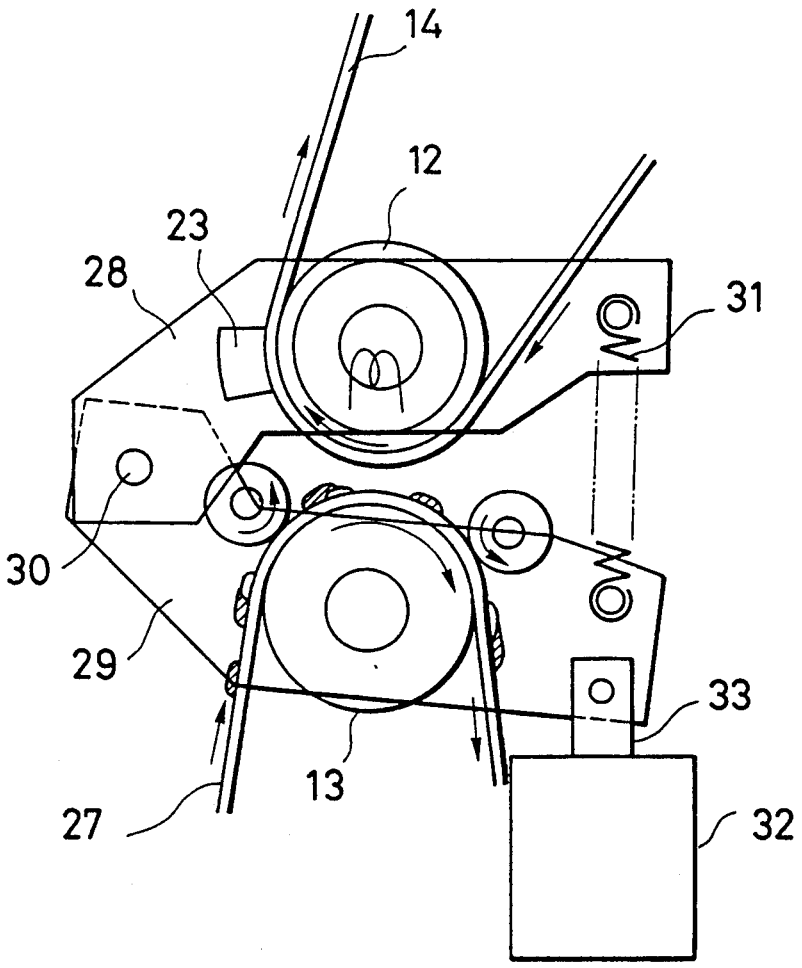
FIG. 4 shows the state of the apparatus when the recording paper has returned according to Embodiments 1 and 2.

When the image produced by the yellow toner 18 has been transferred and fixed up to the trailing edge of the image, the solenoid 32 is excited (FIG. 4). As a result, the movable shaft 33 is pulled in, the frame 29 rotates around the pivot 30, and the pressure roller 13 is separated from the heating roller 12. The pressure roller 13 is then rotated in the reverse direction (the direction opposite to the direction in which it is rotated during transfer and fixing), the recording paper 27 returns, so that it is ready for transfer and fixing of the next color toner.

After the image has been transferred to the recording paper 27, a small amount of yellow toner 18 may remain on the toner image bearing film 14, however this will be wiped off by the cleaner 23 which is brought into contact with the film 14. Further, a discharge brush 24 removes any residual static electricity from the toner image. In this way, the toner image bearing film 14 is cleaned and electrically discharged, and may thus be used again.

After the developing step has been completed, the photosensitive drum 11 separates from the toner image bearing film 14, and is irradiated by a discharge lamp 25 so as to dissipate any residual electrostatic charge on the photosensitive drum. The drum then returns to the electrifying step, and may thus be used again.

Figure 6A:
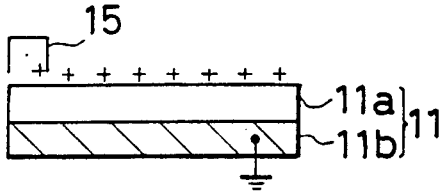
FIGS. 6A to 6D show the electrifying step, the exposure step, the developing step, and the transfer and fixing step that occur in the case of magenta toner.
Figure 6B:
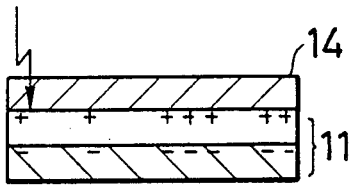
Figure 6C:
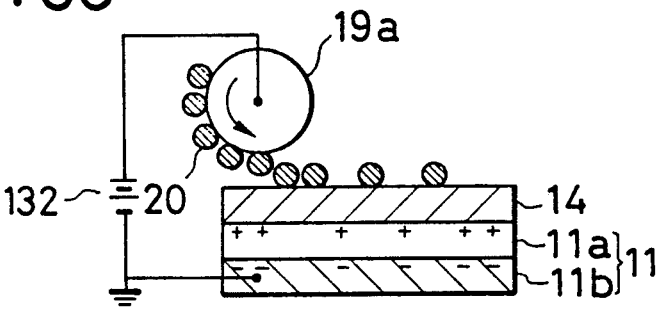
Figure 6D:
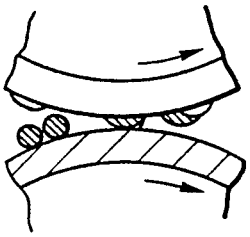

When the transfer and fixing process for an image of yellow toner 18 is complete, an image of magenta toner 20 is developed on the paper via an electrifying step (FIG. 6A), an exposure step corresponding to the magenta image signal (FIG. 6B), a developing step (FIG. 6C) and a transfer and fixing step (FIG. 6D).

Figure 7A:
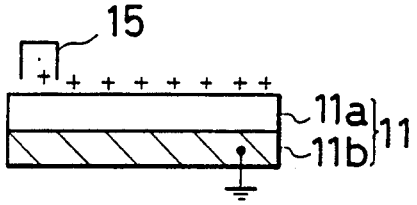
FIGS. 7A to 7D show the electrifying step, the exposure step, the developing step, and the transfer and fixing step that occur in the case of cyan toner.
Figure 7B:
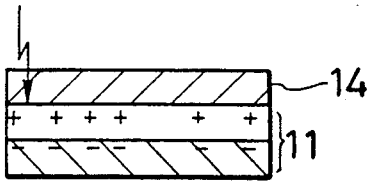
Figure 7C:
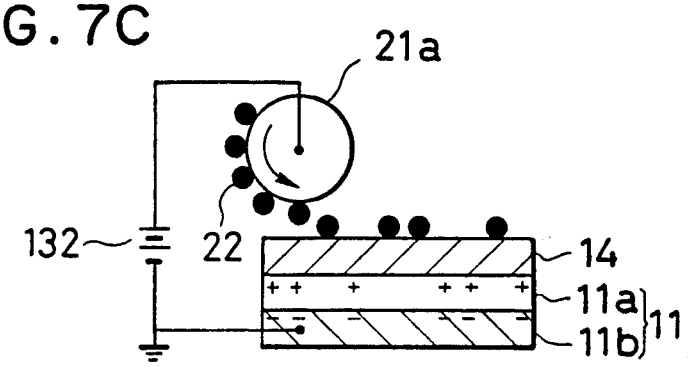
Figure 7D:
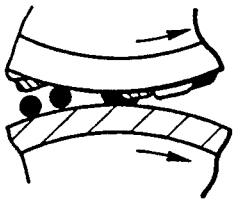

When the transfer and fixing processes for the images of yellow toner 18 and magenta toner 20 are complete, an image of cyan toner is transferred and fixed via an electrifying step (FIG. 7A), an exposure step (FIG. 7B), a developing step (FIG. 7C), and a transfer and fixing step (FIG. 7D).

In this way, toner images of the respective colors are transferred to and fixed on the recording paper 27 successively. During the transfer and fixing, the pressure roller 13 is pressed against the heating roller 12, and the recording paper 27 is fed in synchronism with the toner image bearing film 14. Between the transfer and fixing of the toner image of one color and the transfer and fixing of the toner image of another color, the pressure roller 13 is separated from the heating roller 12, and the recording paper 27 is moved backward.

Apart from the yellow toner 18, the magenta toner 20 and the cyan toner 22, black toner may also be used.

In the transfer and fixing step, the toner image bearing film 14 is heated by the heating roller 12 to reach a temperature of about 160° C. It must therefore be heat resistant, must have insulating properties to a certain extent, and must also be transparent to the source light wavelengths used in the exposure step. From these considerations, the toner image bearing film used may be formed of a material such as polyester, polyimide, polyetherimide, polyethersulfone or polyetheretherketone.

In the above embodiment, from the consideration of transfer efficiency in the transfer and fixing step, a film of Teflon (Trademark, Polytetrafluoroethylene)-coated polyimide is used. The transfer efficiency is then approximately 100%, there is less load on the cleaner 23, and the life of the cleaner 23 can be extended. Further, from consideration of the electric lines of force generated in the developing step, it is desirable that the thickness of the toner image bearing film 14 be no greater than 200 $\mu$m; while from considerations of tensile strength and ease of handling, it is desirable that its thickness be not less than 10 $\mu$m.

Further, in the above embodiment, thermal-fixing toners are used for toners 18, 20 and 22. Microcapsule pressure-fixing toners, which can be fixed by applying a minute pressure, may also be used.

In the exposure step, a toner image bearing film transparent to the light source wavelengths is used, and the exposure is made through the toner image bearing film which moves in close contact with the photosensitive drum. It is however also possible to expose the photosensitive drum directly, and bring the toner image bearing film in contact with the photosensitive drum after the exposure step. In this case, there is no need for the toner image bearing film to be transparent to the light source wavelengths.

In the above embodiment, a photosensitive film can be used in place of photosensitive drum 11.

Embodiment 2

Another embodiment of this invention will now be described with reference to FIGS. 8 to 11D. In these figures, reference numerals identical to those in FIGS. 2 to 7D denote identical or similar devices or elements, and their description is omitted.

Figure 8:
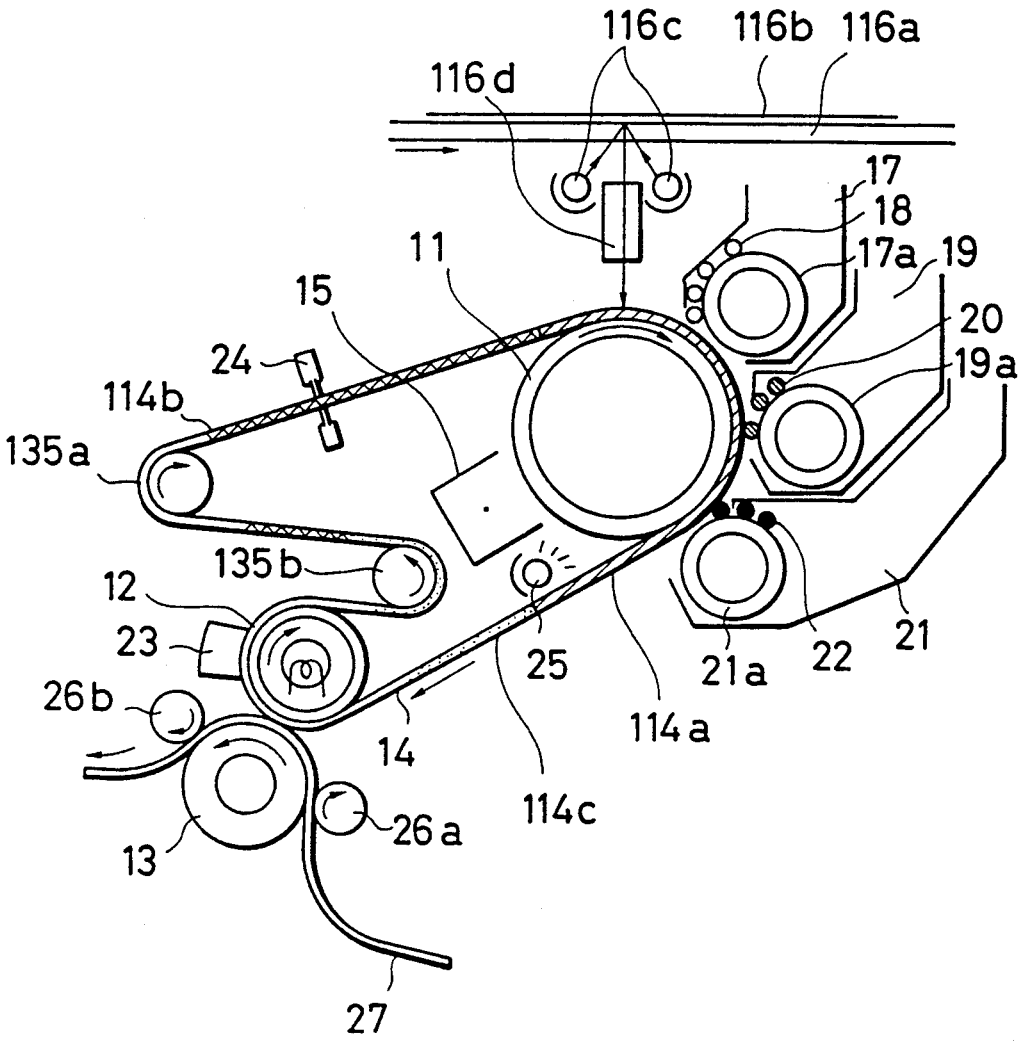
FIG. 8 is a schematic drawing of the color image-forming apparatus of Embodiment 2.

FIG. 8 is a schematic drawing of the color image-forming apparatus of this embodiment.

A toner image bearing film 14 is passed around the photosensitive drum 11, and the heating roller 12, as in Embodiment 1, and in addition, around free rollers **135*a* and 135*b***.

The surface of the toner image bearing film 14 is successively coated to constitute a blue filter part **114*a*, a green filter part 114*b* and a red filter part 114*c*, functioning as blue, green and red filters. When toner images of yellow, magenta and cyan are to be formed, filter parts of the complementary colors, i.e., the blue filter part 114*a*, the green filter part 114*b* and the red filter part 114*c*** are used for the exposure.

A glass plate 116a is installed above the area where the toner image bearing film 14 is in close contact with the photosensitive drum 11, and a white light source 116c is disposed to irradiate the original 116b laid on the glass plate 116a. The light reflected from the original 116b is then made to form an image on the photosensitive drum 11 by an optical imaging device 116d. The image formed by the optical imaging device 116d at any moment is a representation of an image of a linear area of the original, and as the glass plate 116a is moved, this linear area is shifted along the direction of the movement. Thus, the original 116b is effectively scanned.

The glass plate 116a is moved at a constant speed in the direction as indicated by the arrow. The photosensitive drum 11, the heating roller 12 and the pressure roller 13 are rotated in the directions shown by the arrows at a constant peripheral speed, so that the toner image bearing film 14 is moved by friction with the photosensitive drum 11 and the heating roller 12.

The rotation of the photosensitive drum 11 and the movement of the toner image bearing film 14 are synchronized with the movement of the glass plate 116a. More specifically, the movement of the toner image bearing film 14 is so timed that when the leading edge of any of the filter parts 114a, 114b and 114c moves past the exposure device, the scanning of the original is started. The movement of the toner image bearing film 14 and the operation of the developing devices 17, 19 and 21 are also so related that the yellow developing device 17 is activated when the blue filter parts 114a is moving past it, the magenta developing device 19 is activated when the green filter parts 114b is moving past it, and the cyan developing device 21 is activated when the red filter parts 114c is moving past it. The necessary control for these timed operations is made by a controller similar to the controller 50 shown in FIG. 2.

The image-forming processes will be described with reference to FIG. 9A to FIG. 11D.

Figure 9A:
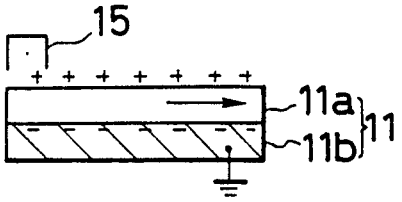
FIGS. 9A to 9D show the electrifying step, the exposure step, the developing step, and the transfer and fixing step that occur in the case of yellow toner.

In the electrifying step shown in FIG. 9A, the surface of the photosensitive drum 11 is directly charged uniformly by the corona discharge device 15.

Figure 9B:
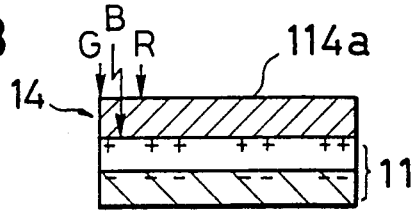

In the subsequent exposure step shown in FIG. 9B, light reflected from glass plate 116a passes through the optical imaging device 116d and the blue filter part 114a of the toner image bearing film 14. For this purpose, the movement of the toner image bearing film 14 is so timed that the leading edge of the blue filter part 114a passes the exposure device 16 as the scanning of the original 116b is started. The blue light B thus color-separated falls on the photosensitive drum 11, and forms an electrostatic latent image for the yellow toner.

Figure 9C:
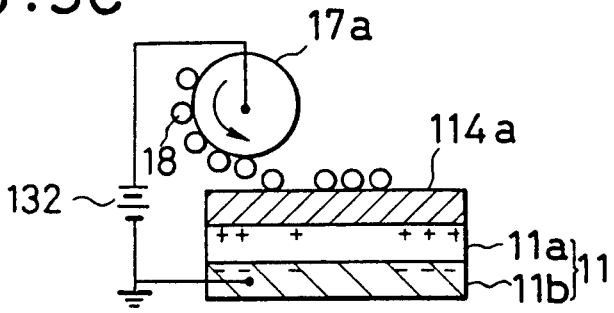

Next, in the developing step shown in FIG. 9C, yellow toner 18 charged on the developer support 17a, adheres to the blue filter part 114a of the toner image bearing film 14.

Figure 9D:
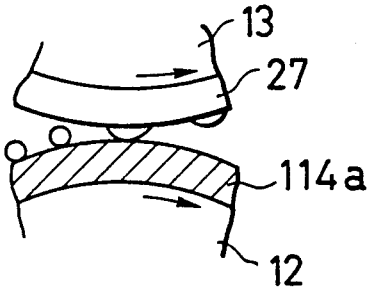

Finally, in the transfer and fixing step shown in FIG. 9D, the recording paper 27, which is supplied and advanced from the supply cassette 40 in synchronization with the yellow toner image on the toner image bearing film 14 is passed around the pressure roller 13. When the transfer and fixing process occurs as shown in FIG. 3, the pressure roller 13 is pressed against the heating roller 12 to hold the toner image bearing film 14 and the recording paper 27 between it and the heating roller 12.

The yellow toner 18 adhering to the blue filter part 114a of the toner image bearing film 14 is then melted by the heat of the heating roller 12, and is caused by pressure to permeate the fibers of the recording paper 27. In this way, the yellow toner image is transferred to and fixed on the recording paper 27.

When the image produced by the yellow toner 18 has been transferred and fixed up to the trailing edge of the image, the pressure roller 13 is separated from the heating roller 12. The pressure roller 13 is then rotated in the reverse direction, the recording paper 27 returns so as to be ready for the transfer and fixing process of the next color toner.

The glass plate 116a is also moved in the reverse direction so as to return to its original position.

After an image of yellow toner 18 has been transferred and fixed as described above, a magenta toner image is transferred and fixed via an electrifying step, an exposure step, a developing step, and a transfer and fixing step, as shown in FIGS. 10A to 10D.

Figure 10A:
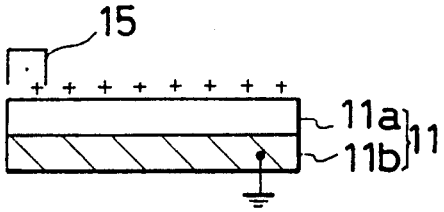
FIGS. 10A to 10D show the electrifying step, the exposure step, the developing step, and the transfer and fixing step that occur in the case of magenta toner.
Figure 10B:
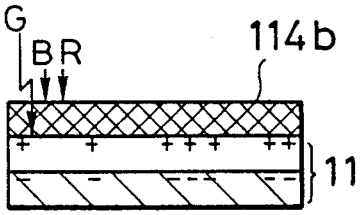

In the exposure step shown in FIG. 10B, reflected light passes through the green filter part 114b of the toner image bearing film 14. For this purpose, the leading edge of the green filter part 114b is made to pass the exposure device 16 when the second scanning of the original 116b is started. The green light G thus color-separated falls on the photosensitive drum 11, and forms an electrostatic latent image.

Figure 10C:
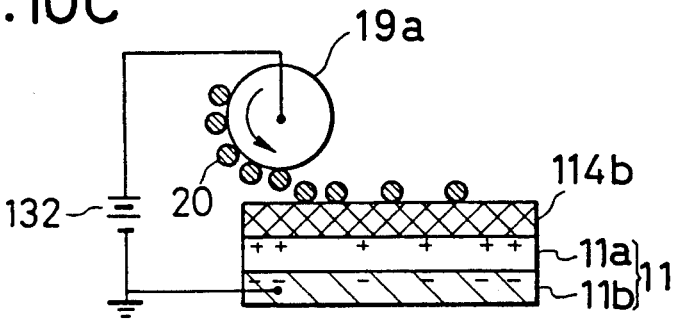

In the developing step shown in FIG. 10C, magenta toner 20 on the developer support 19a, adheres to the green filter part 114b of the toner image bearing film 14.

Figure 10D:
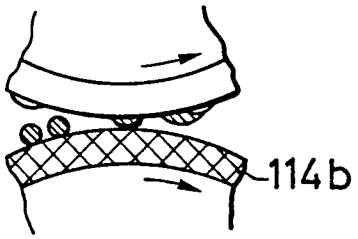

In the transfer and fixing step shown in FIG. 10D, an image of magenta toner 20 is transferred and fixed over the image of yellow toner 18 which has been transferred to and fixed on the recording paper 27.

After images of yellow toner 18 and magenta toner 20 have been transferred and fixed as described above, an image of cyan toner is transferred and fixed via an electrifying step, an exposure step, a developing step and a transfer and fixing step, as shown in FIGS. 11A to 11D.

Figure 11A:
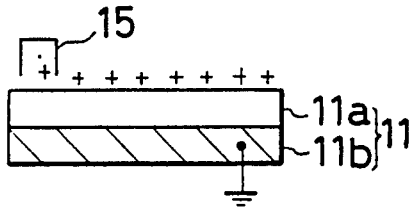
FIGS. 11A to 11D show the electrifying step, the exposure step, the developing step, and the fourth transfer and fixing step that occur in the case of cyan toner.
Figure 11B:
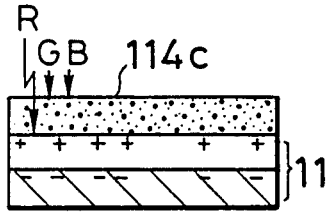

In the exposure step shown in FIG. 11B, light reflected from the original 116b passes through the red filter part 114c, which is made to pass the exposure device 16 in time with the commencement of the third scanning of the original 116b. The red light R thus color-separated falls on the photosensitive drum 11, and forms an electrostatic latent image.

Figure 11C:
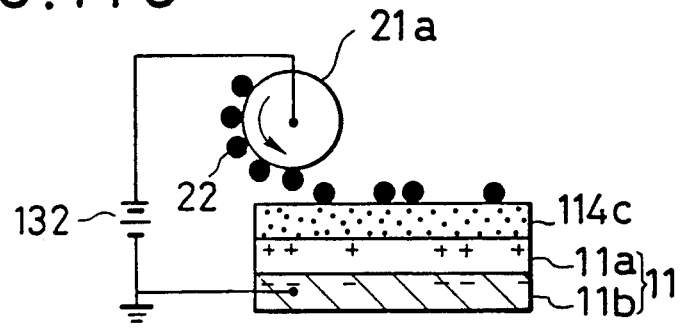

In the developing step shown in FIG. 11C, cyan toner 22 on the developer support 21a, adheres to the red filter part 114c of the toner image bearing film 14.

Figure 11D:
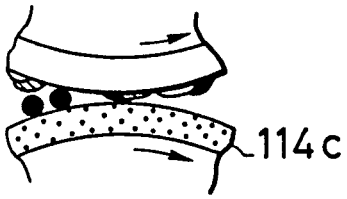

In the transfer and fixing step shown in FIG. 11D, an image of cyan toner 22 is transferred and fixed over the image of yellow toner 18 and the image of magenta toner 22 which have been transferred to and fixed on the recording paper 27, thereby forming a color image.

In this way, the toner images on the filter parts are successively transferred to and fixed on the recording paper 27 while the pressure roller 13 is pressed against the heating roller 12. Between the transfer and fixing of the toner image of one color and the transfer and fixing of the toner image of another color, the pressure roller 13 is separated from the heating roller 12, and the recording paper 27 is moved backward.

Embodiment 2 can be modified in the same manner as described with reference to Embodiment 1.

Embodiment 3

A further embodiment of this invention will now be described with reference to FIGS. 12 to 18.

In these drawings, reference numerals identical to those in FIGS. 2 to 11D denote identical or similar devices or elements, and their description is omitted.

Figure 12:
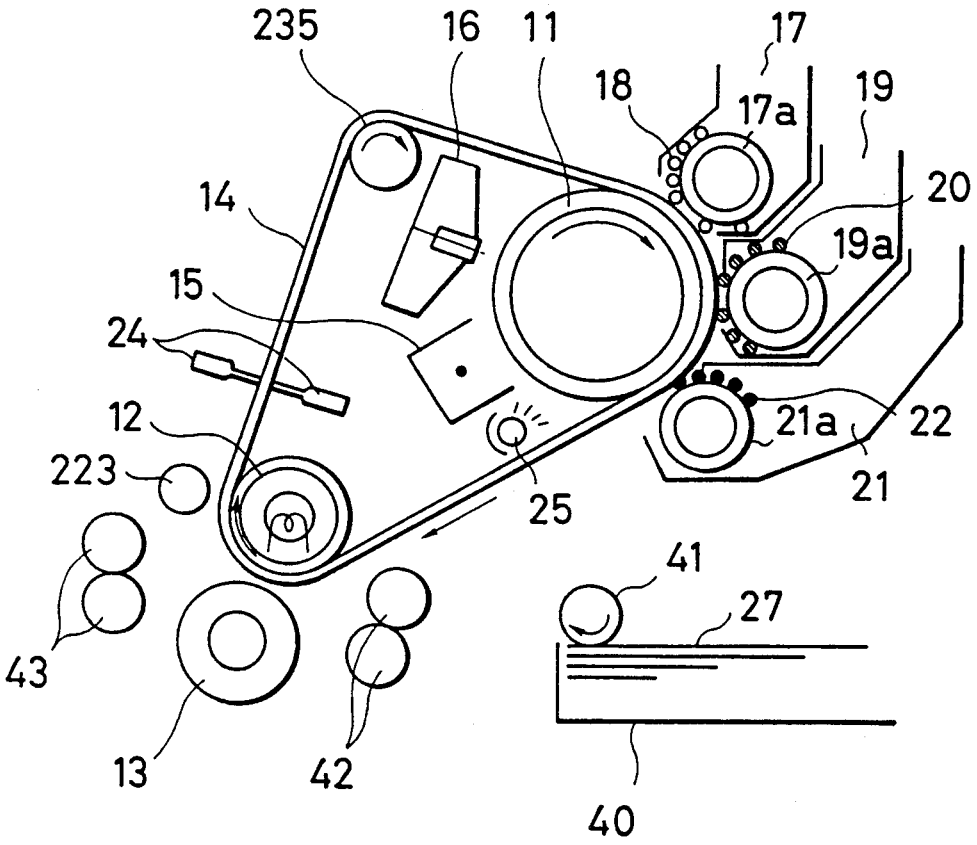
FIG. 12 is a schematic drawing of the color image-forming apparatus of Embodiment 3 of the present invention.

FIG. 12 is a schematic drawing of the color image-forming apparatus of this embodiment.

In this embodiment, a color image consisting of superimposed toner images of three colors is first formed on the toner image bearing film 14, and then this color image is transferred onto a recording paper 27. This is achieved by synchronizing the exposure step with the movement of the toner image bearing film 14. More specifically, commencement of exposure for an image of each color must be controlled to take place such that the leading edge of the area for the toner image on the toner image bearing film 14 is brought into contact with the leading edge of the area of the latent image on the photosensitive drum 11. This control is also performed by a controller similar to the controller 50 shown in FIG. 2, with the aid of means for detecting the position of the leading edge of the area for the toner image on the toner image bearing film 14.

The toner image of each color on the toner image bearing film 14 is temporarily fixed before the toner image of another color is developed on it so that the toners formed on the toner image bearing film will not be mixed with the toner of the different color inside the developing device. For the temporary fixing on the toner image bearing film 14, the heating roller 12 heats the toner image bearing film 14 while the pressure roller 13 and a fixing cleaner 223 are kept separated from the heating roller 12. When the color image consisting of all the colors is transferred to the film 4, the pressure roller 13 and the cleaner 223 are pressed against the heating roller 12, and the recording paper 27 is fed between the pressure roller 13 and the toner image bearing film 14 on the heating roller 12.

The toner image bearing film 14 is passed around the photosensitive drum 11, and the heating roller 12, and, additionally a free roller 235. The exposure device 16 is provided to face the photosensitive drum 11 directly, i.e., without the toner image bearing film 14 interposed. The free roller 235 is provided so that the portion of the photosensitive drum arc which is not covered by the toner image bearing film 14 is long enough to permit the exposure device to be disposed facing the photosensitive drum 11, i.e., inside the space defined by the inner surface of the toner image bearing film 14, and the uncovered part of the photosensitive drum 11, as well as to ensure that the toner image bearing film 14 has a sufficient length for a complete toner image to be formed on it.

The cleaner 223 is provided facing the toner image bearing film 14 passing round the heating roller 12. The cleaner 223 can selectively assume a contact position in which it is in pressure-contact with the toner image bearing film 14 and a release position in which it is separated from the toner image bearing film 14.

Figure 13:
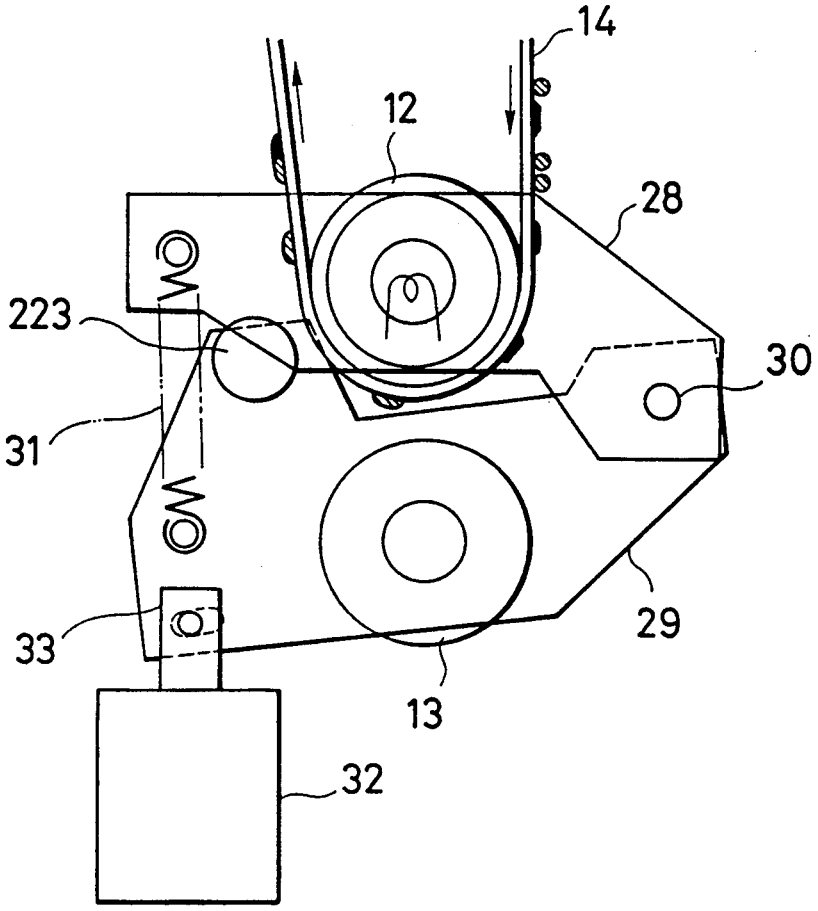
FIG. 13 shows the state of the apparatus when color images are formed.
Figure 14:
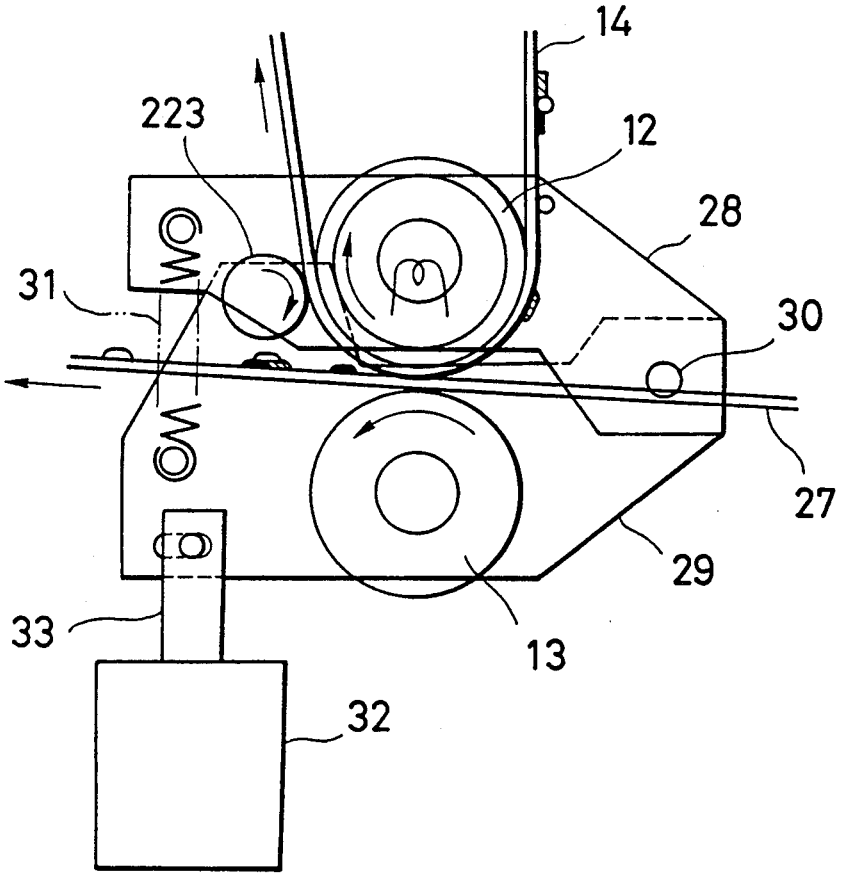
FIG. 14 shows the state of the apparatus during the transfer and fixing step.

FIG. 13 and FIG. 14 show a mechanism for moving the pressure roller 13 and the cleaner 223 between two positions. FIG. 13 shows the apparatus of the present invention in the release position, while FIG. 14 shows it in the contact position. The mechanism shown in these figures is similar to that shown in FIG. 3 and FIG. 4, except that the cleaner 223 is also mounted on the frame 29 and moves with the pressure roller 13.

When color images are to be formed, the photosensitive drum 11 and the heating roller 12 are rotated at a constant peripheral speed in the direction shown by the arrows. As a result, the toner image bearing film 14 is moved in the direction shown by the arrow.

The image-forming processes will be described with reference to FIG. 15A to FIG. 18.

Figure 15A:
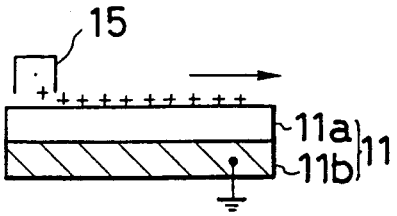
FIGS. 15A to 15D show the electrifying step, the exposure step, the developing step, and the deposition step that occur in the case of cyan toner.

In the electrifying step shown in FIG. 15A, the surface of the photosensitive drum 11 is directly charged uniformly by the corona discharge device 15.

Figure 15B:
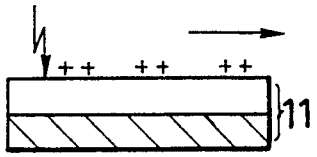

In the subsequent exposure shown in FIG. 15B, light corresponding to the cyan image signal produced by the exposure device 16 irradiates the photosensitive drum 11 to form an electrostatic latent image.

Figure 15C:
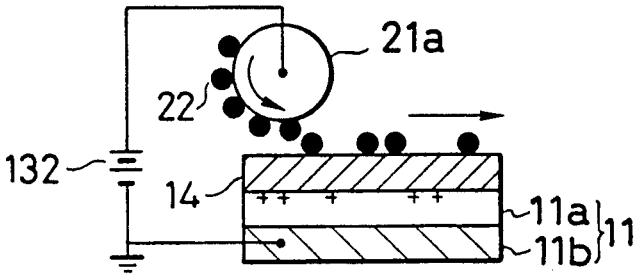

Next, in the developing step shown in FIG. 15C, charged cyan toner 22 on the developer support **21*a*, adheres to the toner image bearing film 14**.

After the above process, the toner image formed on the toner image bearing film 14 adheres to the toner image bearing film 14 by a weak electrostatic force.

Figure 15D:
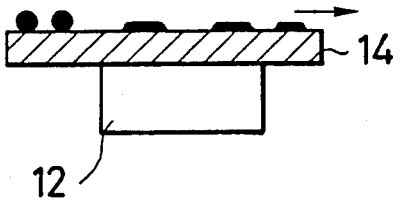

Finally in the deposition step shown in FIG. 15D, the toner image bearing film 14, upon which the image of cyan toner 22 is formed, arrives at the heating roller 12 and the cyan toner 22 is melted by the heat of the heating roller 12. Due to this heating, the cyan toner 22 adheres to the toner image bearing film 14 with a stronger force than the electrostatic force alone, in other words, the cyan toner image is temporarily fixed on the toner image bearing film 14.

During this deposition, the pressure roller 13 and the cleaner 223 are removed from the heating roller 12.

This completes the cyan image-forming step. Residual static electricity on the toner image bearing film 14 is removed by the discharge brush 24 before proceeding to the subsequent magenta image-forming process. In this way, the toner image bearing film 14 is electrically discharged.

Figure 16A:
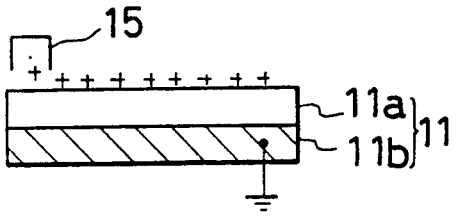
FIGS. 16A to 16D show the electrifying step, the exposure step, the developing step, and the deposition step that occur in the case of magenta toner.
Figure 16B:
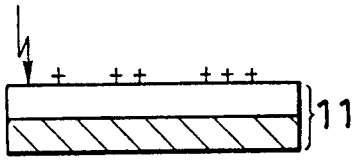
Figure 16C:
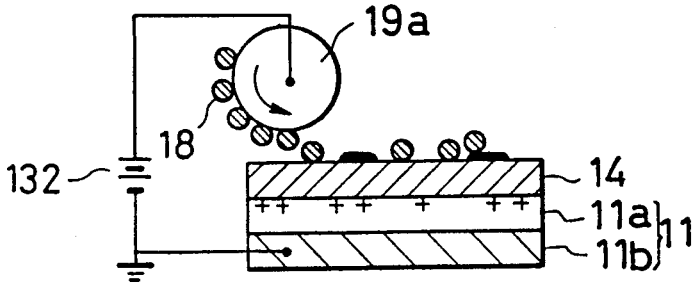

After an image of cyan toner 22 is temporarily fixed as described above, an image of magenta toner 20 is developed on the toner image bearing film 14 upon which the image of cyan toner 22 has been formed, via an electrifying step (FIG. 16A), an exposure step (FIG. 16B), and a developing step (FIG. 16C). The image of magenta toner 20 is exactly superimposed with the image of cyan toner 22, by the control of the controller 50, as described above. As the cyan toner 22 is fixed on the toner image bearing film 14, it does not mix with the other toners inside the developing device 19.

Figure 16D:
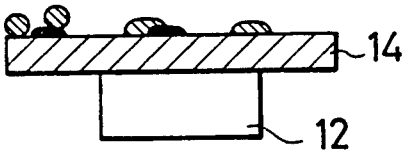

Finally in the deposition step shown in FIG. 16D, when the toner image bearing film 14 upon which the image of cyan toner 22 has been temporarily fixed and the image of magenta toner 20 has been formed, as described above, arrives at the the heating roller 12, the magenta toner 20 is melted by the heat of the heating roller 12. Due to this heating, the magenta toner 20 adheres to the toner image bearing film 14 with a stronger force than the electrostatic force alone.

Figure 17A:
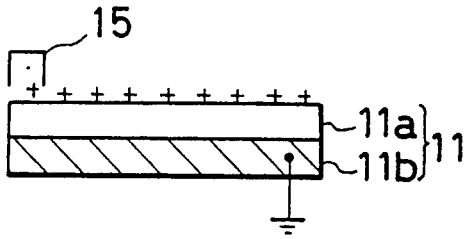
FIGS. 17A to 17C show the electrifying step, the exposure step, the developing step, and the transfer and fixing step that occur in the case of yellow toner.
Figure 17B:
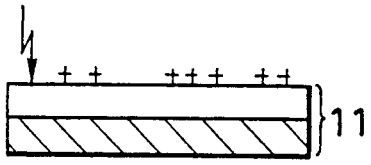
Figure 17C:
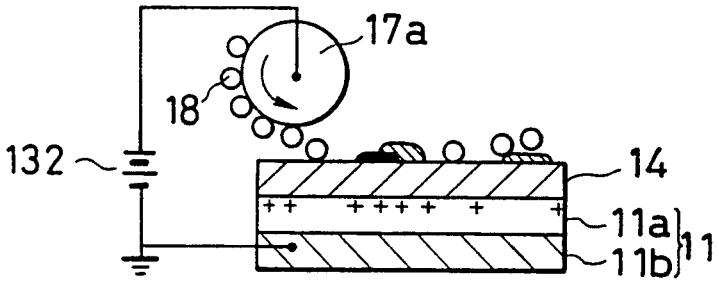

After images of cyan toner 22 and magenta toner 20 are temporarily fixed as described above, an image of yellow toner 18 is developed on the toner image bearing film 14 upon which the images of cyan toner 22 and magenta toner 20 have been formed, via an electrifying step (FIG. 17A), an exposure step (FIG. 17B), and a developing step (FIG. 17C). This time again, the image of yellow toner 18 is exactly superimposed on the images of cyan toner 22 and magenta toner 20. Thus, a color image consisting of the images of cyan toner 22 and magenta toner 20 that have been temporarily fixed and the image of yellow toner 18 that has been developed but not melted for temporary fixing is formed on the toner image bearing film 14.

Figure 18:
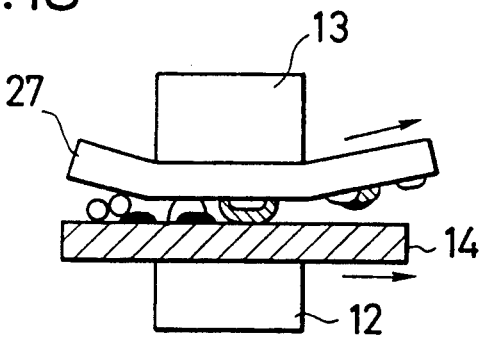
FIG. 18 shows the transfer and fixing step.

Finally in the transfer and fixing step shown in FIG. 18, the above-mentioned color image on the toner image bearing film 14 is moved to the heating roller 12.

At this time, as shown in FIG. 14, the pressure roller 13 and the cleaner 223 are brought into pressure-contact with the heating roller 12. Simultaneously, the recording paper 27 is supplied by the paper pick-up roller 41, and is advanced by the paper advance rollers 42 between the pressure roller 13 and the heating roller 12 in synchronization with the toner images on the toner image bearing film 14. The color image on the toner image bearing film 14 is then melted by the heat of the heating roller 12, whereupon the pressure causes the melted toners 18, 20 and 22 to permeate the fibers of the recording paper 27. As a result, a color image is formed on the recording paper 27. The recording paper 27 is then ejected by the ejecting rollers 43.

Small amounts of toners 18, 20 and 22 may remain on the toner image bearing film 14 after transfer to the recording paper 27, however they will be wiped off by the cleaner 223 which is now also in pressure-contact with the heating roller 12.

In this way, the pressure roller 13 is separated from the heating roller 12 until all the toner images of all the three colors have been formed on the toner image bearing film 14. Toner images of the three colors are successively formed on the toner image bearing film 14 being superimposed with each other, and the first three toners being temporarily fixed on the toner image bearing film 14 by the heat of the heating roller 12. When the toner images of all the three colors have been formed on the toner image bearing film 14, the pressure roller 13 is pressed against the heating roller 12, and the recording paper 27 is supplied so that the toner images of all the three colors are transferred to and fixed on the recording paper 27 simultaneously. The cleaner 223, for removing any residual toner on the toner image bearing film 14, is activated when the transfer of the toner images of all the three colors has taken place. Before then, it is deactivated and restrained from the cleaning action.

In the embodiment described above, the toner 18 which is the last of the color toners 18, 20 and 22 to be developed, is transferred to and fixed on the recording paper 27, directly, i.e., without being temporarily fixed on the toner image bearing film 14. It may alternatively be first temporarily fixed on the toner image bearing film 14 as in the case of the other toners 20 and 22, and subsequently transferred to and fixed on the recording paper 27.

Embodiment 3 can be modified in the same manner as described with reference to Embodiments 1 and 2.

Embodiment 4

A still further embodiment of this invention will now be described with reference to FIGS. 19 to 23.

In these figures, reference numerals identical to those in FIGS. 2 to 18 denote identical or similar devices or elements, and their description is omitted.

Figure 19:
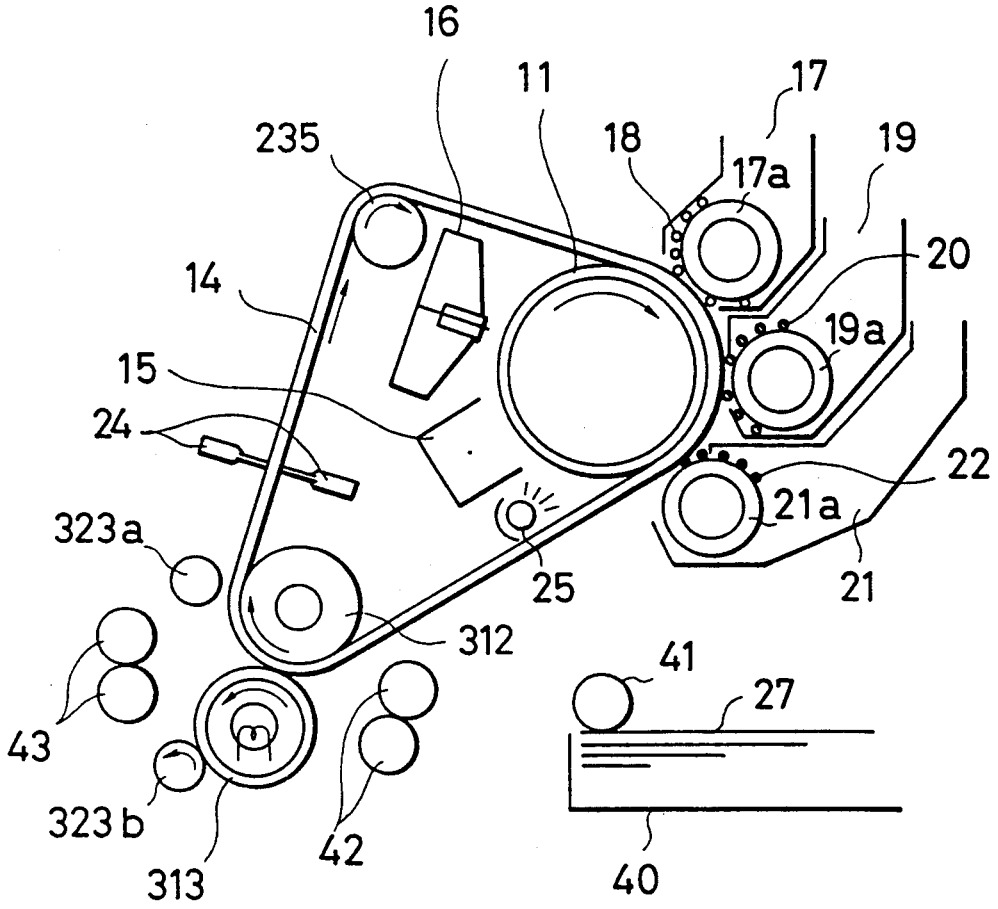
FIG. 19 is a schematic drawing of the color image-forming apparatus of Embodiment 4.

FIG. 19 is a schematic drawing of the color image-forming apparatus of this embodiment. This embodiment is similar to Embodiment 3, but the position of the pressure roller and the heating roller are exchanged. The pressure roller and the heating roller are renumbered as 312 and 313, respectively, but their structures are similar to the pressure roller 13 and the heating roller 12, respectively. The toner image bearing film 14 is passed around the photosensitive drum 11, the pressure roller 312 and the free roller 235.

Because of the reversed disposition of the heating roller 313 it must be kept pressed against the pressure roller 312 around which the toner image bearing film 14 is passed. Accordingly, the heating roller 313 is contacted with the images of cyan toner and magenta toner that have been formed on the outer surface of the toner image bearing film 14 when the toner image bearing film 14 is passed through the heating roller 313 for temporary fixing. In order to reduce the offset of toner onto the heating roller 313, the surface energy of the heating roller 313 must be less than the surface energy of the toner image bearing film 14, and for this purpose, the metal surface of the heating roller 313 is Teflon coated.

A fixing cleaner 323*a* is provided to face the toner image bearing film 14 on the pressure roller 312. The fixing cleaner 323*a* can selectively assume a contact position in which it is pressed against the pressure roller 312 and a release position in which it is separated from the pressure roller 312. Another fixing cleaner 323*b* is provided, being pressed against the heating roller 313. The function of the cleaner 323*b* is to remove any toner that has been offset to the heating roller 313. A controller similar to the controller 50 shown in FIG. 2 is also provided in this embodiment, but its illustration is omitted.

The image-forming processes will be described with reference to FIG. 20A to FIG. 23.

Figure 20A:
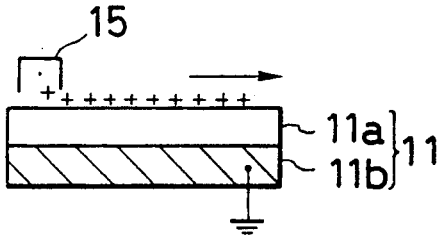
FIGS. 20A to 20D show the electrifying step, the exposure step, the developing step, and the deposition step that occur in the case of cyan toner.

In the electrifying step shown in FIG. 20A, the surface of the photosensitive drum 11 is charged uniformly by the corona discharge device 15.

Figure 20B:
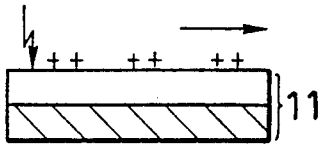

In the subsequent exposure shown in FIG. 20B, light corresponding to the cyan image signal produced by the exposure device 16 irradiates the photosensitive drum 11 to form an electrostatic latent image.

Figure 20C:
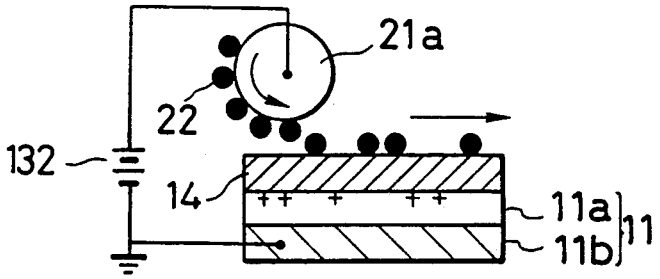

Next, in the developing step shown in FIG. 20C, charged cyan toner 22 on developer support 21*a*, adheres to the toner image bearing film 14. After the above process, the toner image formed on the toner image bearing film 14 adheres to the toner image bearing film by a weak electrostatic force.

Figure 20D:
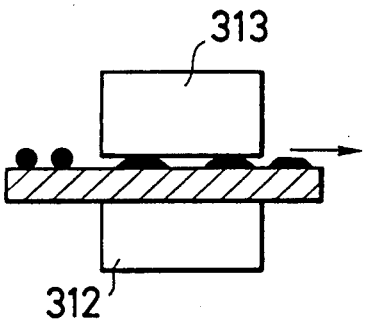

Finally in the deposition step shown in FIG. 20D, when the toner image bearing film 14, upon which the image of cyan toner 22 is formed, arrives at the location where the pressure roller 312 and the heating roller 313 are in pressure-contact, cyan toner 22 is melted by the heat of the heating roller 313. Due to this heating, cyan toner 22 adheres to the toner image bearing film 14 with a stronger force than the electrostatic force alone.

In this process, a small toner offset due to the heating roller 313 may occur, but the heating roller 313 is cleaned by the cleaner 323*b*.

This completes the cyan image-forming step.

Figure 21A:
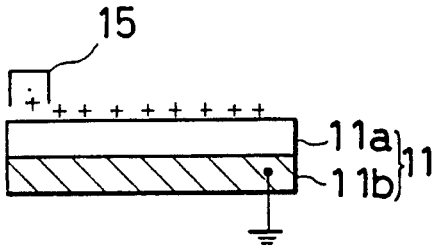
FIGS. 21A to 21D show the electrifying step, the exposure step, the developing step, and the deposition step that occur in the case of magenta toner.
Figure 21B:
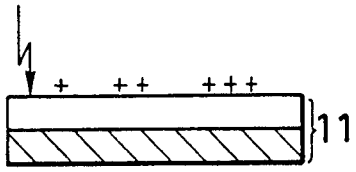
Figure 21C:
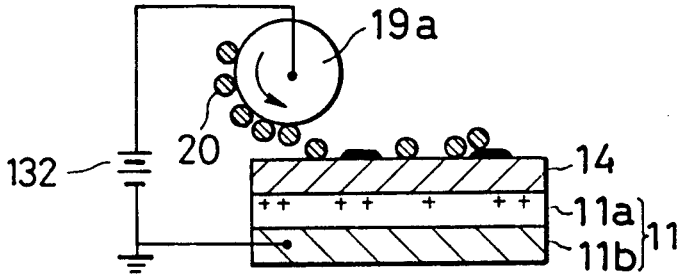

After an image of cyan toner 22 has been temporarily fixed as described above, an image of magenta toner 20 is developed, being superimposed, on the toner image bearing film 14 upon which the image of cyan toner 22 has been formed, via an electrifying step (FIG. 21A), an exposure step (FIG. 21B), and a developing step (FIG. 21C). In this process, as the cyan toner 22 is temporarily fixed on the toner image bearing film 14, it does not mix with magenta toner 20 inside the developing device 19.

Figure 21D:
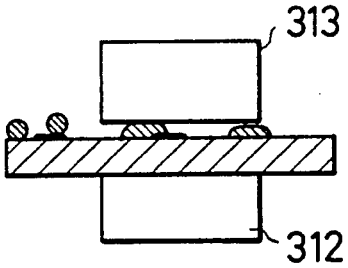

Finally in the deposition step shown in FIG. 21D, when the toner image bearing film 14 upon which the image of cyan toner 22 has been temporarily fixed and the image of magenta toner 20 has been formed as described above, arrives at the location where the pressure roller 312 and the heating roller 313 are in contact, the magenta toner 20 is melted by the heat of the heating roller 313. Due to this heating, the magenta toner 20 adheres to the toner image bearing film 14 with a stronger force than the electrostatic force alone.

Figure 22A:
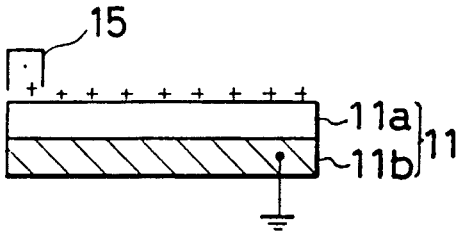
FIGS. 22A and 22C show the electrifying step, the exposure step, the developing step, and the transfer and fixing step that occur in the case of yellow toner.
Figure 22B:
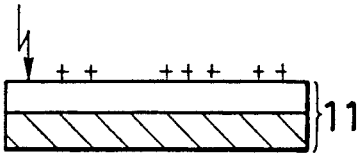
Figure 22C:
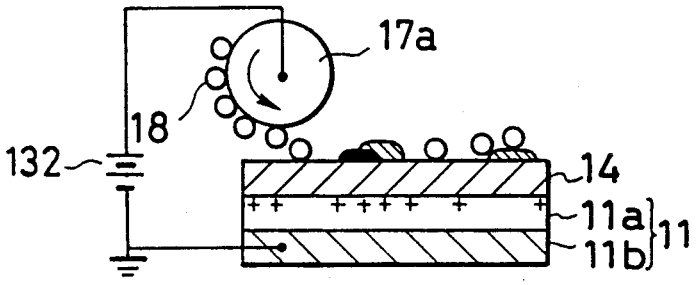

After images of cyan toner 22 and magenta toner 20 are temporarily fixed as described above, an image of yellow toner 18 is developed, being superimposed, on the toner image bearing film 14 upon which the images of cyan toner 22 and magenta toner 20 have been formed, via an electrifying step (FIG. 22A), an exposure step (FIG. 22B), and a developing step (FIG. 22C).

Figure 23:
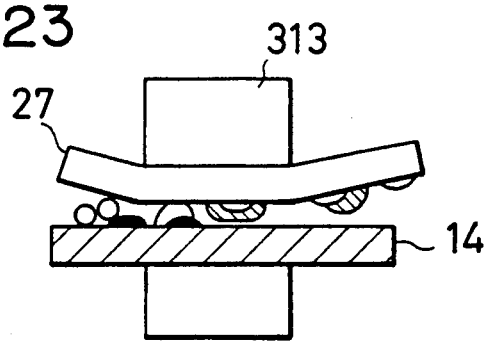
FIG. 23 shows the transfer and fixing step.

Finally in the transfer and fixing step shown in FIG. 23, the toner image bearing film 14 upon which the images of cyan toner 22 and magenta toner 20 have been temporarily fixed, and the image of yellow toner 18 has been formed as described above, is moved to the location where the pressure roller 312 and the heating roller 313 are in pressure-contact.

At this time, the recording paper 27 is supplied by the paper pick-up roller 41, and is advanced by the paper advance rollers 42 between the pressure roller 312 and the heating roller 313, in synchronization with the toner images. The toner images on the toner image bearing film 14 are then melted by the heat of the heating roller 313, caused to permeate the fibers of the recording paper 27 by pressure, transferred to and fixed on the recording paper. As a result, a color image is formed on the recording paper 27. The recording paper 27 is then ejected by the ejecting rollers 43.

While the toner image bearing film 14 is passed around the pressure roller 312 for temporary fixing of the images of cyan toner and magenta toner, the cleaner **323*a* is kept separated from the pressure roller 312. When the toner image bearing film 14 is passed around the pressure roller 312 for transfer of the color image to the recording paper 27, the cleaner 323*a* is pressed against the pressure roller 312 to remove any residual toner from the toner image bearing film 14**.

In this way, the pressure roller 312 is separated from the heating roller 313 until the toner images of all the three colors have been formed. Toner images of all the three colors are successively formed on the toner image bearing film 14, being superimposed with each other, with the first and the second being temporarily fixed on the toner image bearing film 14 by the heat of the heating roller 312. When toner images of all the three colors have been formed on the toner image bearing film 14, the recording paper is supplied and the toner images of all the three colors are simultaneously transferred to and fixed on the recording paper. The cleaner **323*a* for removing any residual toner on the toner image bearing film 14 is activated when the transfer of the toner images of all the colors has taken place. Until then, the cleaner 323*a*** is deactivated and restrained from the cleaning action.

Embodiment 4 can be modified in the same manner as described with reference to Embodiments 1, 2 and 3.

What is claimed is:

1. A method for forming color images, having a plurality of colors, on a recording paper, comprising the steps of:

(a) electrifying a photosensitive member;

(b) exposing the photosensitive member to an image pattern to form a corresponding latent image on the photosensitive member;

(c) developing a toner image on a toner image bearing film, a portion of which contacts the photosensitive member, by causing toner to be adhered thereon;

(d) advancing a leading edge of the recording paper to a transferring and fixing zone in sychronism with a leading edge of the toner image on the toner image bearing film, the transferring and fixing zone comprising a fixed roller and a mobile roller which moves between a pressure contact position closely adjacent to the fixed roller and a released position a distance from the fixed roller, the toner image bearing film and the recording paper traveling between the fixed and mobile rollers;

(e) transferring and fixing the toner image on the toner image bearing film onto the recording paper with the mobile roller in the pressure contact position;

(f) returning the leading edge of the recording paper to the transferring and fixing zone with the mobile roller in the released position; and (g) successively repeating the preceding steps for toners of different colors thereby successively forming different color toner images on the toner image bearing film and successively transferring and fixing each of the color toner images on the recording paper.

2. A method for forming color images according to claim 1, wherein said toner is a heat fixing toner.

3. A method for forming color images according to claim 1, wherein said toner is a pressure fixing toner.

4. A method for forming color images according to claim 1, wherein, said toner image bearing film is transparent to the wavelength of said image pattern of reflected light, and wherein the photosensitive member is exposed through the toner image bearing film.

5. A color electrophotography apparatus comprising:

a photosensitive member;

an electrifying device facing said photosensitive member for uniformly electrifying the photosensitive member;

an exposure device for exposing the photosensitive member, successively, to a plurality of light images, each light image corresponding to a color image signal thereby forming a plurality of electrostatic latent images of said respective colors on the photosensitive member;

a toner image bearing film passing around said photosensitive member;

development devices for successively developing a plurality of color toner images by adhering color toner corresponding to said respective color image signals onto said toner image bearing film, each toner image corresponding to a respective electrostatic latent images;

a transfer device for transferring each toner image from the toner image bearing film onto recording paper, said transfer device comprising a first roller and a second roller juxtaposed with said first roller, said second roller being selectively movable between a contact position in which it is pressed against said first roller and a release position in which it is separated from said first roller, said toner image bearing film passing around said first roller and being interposed between said first and second rollers, said second roller being pressed against said first roller when said toner image bearing film bearing said toner image passes between said first and second rollers;

means for moving said toner image bearing film past said development devices and said transfer device; and means for feeding a recording paper past said transfer device in synchronization with the movement of said toner images on said toner image bearing film past said transfer device, said feeding means moving the recording paper backward between the successive transfers of the respective color toner images, said second roller being in the release position when said recording paper is moved backward, whereby the toner images of the respective colors are successively transferred to and fixed on the recording paper.

6. Apparatus according to claim 5, wherein said toner image bearing film is an endless film repeatedly passing around said photosensitive member and moving past said transfer device.

7. Apparatus according to claim 5, wherein said toner image bearing film is transparent to the wavelength of said plurality of light images of said exposure device; and said exposure device is provided facing said photosensitive member through said toner image bearing film.

8. Apparatus according to claim 5, wherein said first roller is a heating roller and said second roller is a pressure roller.

9. Apparatus according to claim 5, further comprising a cleaner for removing any residual toner on the toner image bearing film after the transfer of the toner image to the recording paper.

10. Apparatus according to claim 5, wherein said recording paper is fed forward and backward, and is wound on said second roller.

11. A color electrophotography apparatus, comprising:

a photosensitive member;

an electrifying device facing said photosensitive member for uniformly electrifying the photosensitive member;

an exposure device for exposing the photosensitive member, successively, to a plurality of light images, each light image corresponding to a color image signal, thereby forming a plurality of electrostatic latent images of said respective colors on the photosensitive member;

an endless toner image bearing film passing around said photosensitive member;

development devices for successively developing a plurality of color toner images by adhering color toner corresponding to said respective color image signals onto said toner image bearing film, each toner image corresponding to a respective electrostatic latent images;

a transfer device for transferring said plurality of color toner images from the toner image bearing film onto recording paper, said transfer device comprises a heating roller and a pressure roller juxtaposed with said heating roller, said pressure roller being selectively movable between a contact position in which it is pressed against the heating roller and a release position separated from the heating roller, said toner image bearing film passing around said heating roller and being interposed between said heating and pressure rollers, whereby said pressure roller is separated from said heating roller when the toner image bearing film bearing the toner images of the respective colors passes between the heating roller and the pressure roller until all the toner images have been formed;

means for moving said toner image bearing film past said development devices and said transfer device, each of the plurality of color toner images being successively formed on the toner image bearing film and superimposed on each other, and each of the plurality of color toner images except the last one formed being temporarily fixed on said toner image bearing film by the heat from said heating roller; and means for feeding a recording paper to the transfer device after the plurality of color toner images have been formed on said toner image bearing film, whereby the plurality of color toner images are simultaneously transferred to and fixed on the recording paper.

12. Apparatus according to claim 11, further comprising a cleaner for removing any residual toner from the toner image bearing film after the transfer of all the toner images of all the colors to the recording paper, said cleaner being restrained from cleaning until all the toner images are transferred to the recording paper.

13. Apparatus according to claim 11, wherein said exposure device is provided to face the photosensitive member directly, such that said exposure is made by direct irradiation of the photosensitive member with said light image.

14. A color electrophotography apparatus, comprising:

a photosensitive member;

an electrifying device facing said photosensitive member for uniformly electrifying the photosensitive member;

an exposure device for successively exposing the photosensitive member to a plurality of light images corresponding to a color image signal, thereby forming a plurality of electostatic latent images of said respective colors on the photosensitive member;

an endless toner image bearing film passing around said photosensitive member;

development devices for successively developing a plurality of color toner images by adhering color toner corresponding to said respective color image signal onto said toner image bearing film when it is passing around said photosensitive member;

a transfer device for transferring said plurality of toner images from the toner image bearing film onto recording paper, said transfer device comprising a pressure roller and a heating roller in contact with said pressure roller, said toner image bearing film passing around one of said heating roller and said pressure roller and being interposed between said pressure and said heating rollers, wherein the plurality of toner images are sucessesively formed and superimposed on each other and temporarily fixed on said toner image bearing film, when said toner image bearing film bearing the respective toner images passes between said heating roller and said pressure roller, by said heating roller being pressed against said pressure roller;

means for moving said toner image bearing film past said development devices and said transfer device, each of the plurality of color toner images being successively formed on the toner image bearing film and superimposed on each other, and each of the plurality of color toner images except the last one formed being temporarily fixed on said toner image bearing film by the heat and the pressure from said heating roller and said pressure roller; and means for feeding the recording paper to said transfer device between the toner image bearing film and one of said pressure roller and said heating roller after all the toner images have been formed on the toner image bearing film, whereby the toner images of a plurality of colors constituting the color image are simultaneously transferred to and fixed on the recording paper.

15. Apparatus according to claim 14, further comprising a cleaner for removing any residual toner from the toner image bearing film after the transfer of all the toner images to the recording paper, said cleaner being restrained from cleaning until all the toner images are transferred to the recording paper.

16. Apparatus according to claim 14, wherein said exposure device is provided to face the photosensitive member directly, such that said exposure is made by direct irradiation of the photosensitive member with said light image.

17. A method for forming color images, having a plurality of colors, on a recording paper, comprising the steps of:

(a) electrifying a photosensitive member;

(b) exposing the photosensitive member to a pattern of light corresponding to a color of the image to form a corresponding latent image on the photosensitive member;

(c) developing a toner image on a toner image bearing film, a portion of which contacts the photosensitive member, by adhering toner to the toner image bearing film in the pattern of said latent image;

(d) melting said toner image to temporarily fix said image on the toner image bearing film and returning a leading edge of the toner image to the heat source until the toner image is melted so as to be fixed temporarily on the toner image bearing film;

(e) repeating steps (b), (c) and (d) for each of said plurality of colors, except that the toner image which is formed last is not melted, thereby forming a plurality of colored toner images on the toner image bearing film;

(f) supplying a leading edge of the recording paper to a transferring and fixing zone; and (g) transferring and fixing all the toner images of said toner image bearing film to the recording paper.

18. A method for forming color images according to claim 17, wherein the toner image bearing film and recording paper are gripped between two rollers in said transfer and fixing step.

19. A method for forming color images according to claim 17, wherein said toner is a heat fixing toner.

20. A method for forming color images according to claim 17, wherein said toner is a pressure fixing toner.

21. A method for forming color images according to claim 17, wherein the step of transferring and fixing comprises feeding the toner image bearing film and recording paper between a fixed roller and a mobile pressure roller which can take up either a pressure contact or release position, said plurality of toner images are successively superimposed on the toner image bearing film in the release position, and all of the color toners on the toner image bearing film are transferred to and fixed on the recording paper in the pressure contact position.

22. A method for forming color images according to claim 17, wherein said portion of the toner image bearing film is brought into contact with the photosensitive member after said exposure, such that said exposure is made by direct irradiation of the photosensitive member with said light pattern.

* * * * *